US008890778B2

(12) United States Patent
Shirouzu et al.

(10) Patent No.: US 8,890,778 B2
(45) **Date of Patent: *Nov. 18, 2014**

(54) DISPLAY DEVICE AND METHOD FOR CONTROLLING THE SAME

(71) Applicant: Panasonic Corporation, Osaka (JP)
(72) Inventors: Hiroshi Shirouzu, Shiga (JP); Tetsurou Nakamura, Kyoto (JP)
(73) Assignee: Panasonic Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/930,016
(22) Filed: Jun. 28, 2013
(65) Prior Publication Data

US 2013/0285889 A1 Oct. 31, 2013

Related U.S. Application Data

(63) Continuation of application No. 12/771,514, filed on Apr. 30, 2010, now Pat. No. 8,547,307, which is a continuation of application No. PCT/JP2009/003023, filed on Jun. 30, 2009.

(30) Foreign Application Priority Data

Jul. 4, 2008 (JP) ..... 2008-176243

(51) Int. Cl.
*G09G 3/30* (2006.01)
*G09G 3/32* (2006.01)
*G09G 3/00* (2006.01)

(52) U.S. Cl.
CPC ..... *G09G 3/30* (2013.01); *G09G 2300/0842* (2013.01); *G09G 3/3233* (2013.01); *G09G 2330/12* (2013.01); *G09G 2320/045* (2013.01); *G09G 3/006* (2013.01); *G09G 2320/0295* (2013.01); *G09G 2320/043* (2013.01)
USPC ..... 345/76; 345/205; 315/169.3

(58) Field of Classification Search
CPC ..... G09G 3/3233; G09G 2320/0233; G09G 3/3258; G09G 3/30; G09G 2300/08; G09G 3/3225; G09G 2310/0272; G09G 2320/0295; G09G 3/14; G09G 3/3283; G09G 3/3291; G09G 3/3275; G09G 2310/02; G09G 2310/0264; G09G 2320/02; G09G 2320/04; G09G 2300/02; G09G 2300/0439; H05B 33/0884; H05B 33/00
USPC ..... 345/204, 690, 76–83; 315/169.3
See application file for complete search history.

(56) References Cited

U.S. PATENT DOCUMENTS

2002/0180717 A1* 12/2002 Ishiyama ..... 345/204
2004/0051684 A1 3/2004 Ishizuka (Continued)

FOREIGN PATENT DOCUMENTS

JP 2004-045647 2/2004
JP 2006-139079 6/2006

(Continued)

OTHER PUBLICATIONS

U.S. Appl. No. 12/762,699 to Kenichi Masumoto et al., which was filed on Apr. 19, 2010, and which is now published as U.S. Pat. Appl. Pub. No. 2010/0201722 on Aug. 12, 2010 and issued as U.S. Pat. No. 8,456,389 on Jun. 4, 2013.

(Continued)

*Primary Examiner* — Stephen Sherman
(74) *Attorney, Agent, or Firm* — Greenblum & Bernstein, P.L.C.

(57) ABSTRACT

A display device includes an organic EL element and a capacitor. A driving transistor is connected to an anode of the organic EL element and passes a current to the organic EL element. The current corresponds to a voltage held in the capacitor. A first switch is between the capacitor and a data line, and the data line supplies the voltage to the capacitor. A voltage detector is connected to the data line for detecting an anode voltage applied to the organic EL element. A second switch is between the anode and the data line. A controller turns on the first switch, causes the organic EL element to emit light, and causes the voltage detector to detect the anode voltage by turning off the first switch and turning on the second switch while the organic EL element is emitting light.

17 Claims, 13 Drawing Sheets

(56) References Cited

U.S. PATENT DOCUMENTS

| | | | |
|---|---|---|---|
| 2004/0080472 | A1 | 4/2004 | Miyakawa et al. |
| 2006/0119549 | A1 | 6/2006 | Maekawa |
| 2007/0195020 | A1 | 8/2007 | Nathan et al. |
| 2008/0030438 | A1 | 2/2008 | Marx et al. |
| 2008/0150845 | A1 | 6/2008 | Ishii et al. |
| 2009/0027377 | A1 | 1/2009 | Kwon |

FOREIGN PATENT DOCUMENTS

| | | |
|---|---|---|
| JP | 2007-536585 | 12/2007 |
| JP | 2008-102404 | 5/2008 |
| JP | 2009-031712 | 2/2009 |
| WO | 2005/109389 | 11/2005 |
| WO | 2007/090287 | 8/2007 |

OTHER PUBLICATIONS

U.S. Appl. No. 12/797,150 to Hiroshi Shirouzu et al., which was filed on Jun. 9, 2010, and which is now published as U.S. Pat. Appl. Pub. No. 2010/0245331 on Sep. 30, 2010 and issued as U.S. Pat. No. 8,089,477 on Jan. 3, 2012.

International Search Report dated Aug. 4, 2009 that issued with respect to PCT/JP2009/003023.

Japan Office Action in JP Patent Application No. 2010-518916, mail date is Mar. 13, 2012.

* cited by examiner

DISPLAY DEVICE AND METHOD FOR CONTROLLING THE SAME

CROSS REFERENCE TO RELATED APPLICATION

This is a continuation of pending U.S. application Ser. No. 12/771,514 filed Apr. 30, 2010, which is a continuation application of PCT Application No. PCT/JP2009/003023 filed Jun. 30, 2009, which claims the benefit of Japanese Patent Application No. 2008-176243 filed on Jul. 4, 2008.

The disclosure of each of these documents, including the specification, drawings and claims, is incorporated herein by reference in its entirety.

BACKGROUND OF THE INVENTION

1. Field of the Invention

The present invention relates to display devices and methods for controlling the same, and in particular, to a method for detecting a variation in characteristics of semiconductor driving active elements.

2. Description of the Related Art

Image display devices in which organic EL elements (also known as organic light emitting diodes, or OLEDs) are used, that is, organic EL displays are known as image display devices with which current-driven luminescence elements are used. Organic EL displays are attracting attention as candidates of the next-generation flat panel display (FPD) because they have advantages of good viewing angle properties and small power consumption.

In a usual organic EL display, organic EL elements which serve as pixels are arranged in a matrix. An organic EL display is called a passive-matrix organic EL display, in which organic electroluminescence elements are provided at intersections of row electrodes (scanning lines) and column electrodes (data lines) and voltages corresponding to data signals are applied to between selected row electrodes and the column electrodes to drive the organic EL elements.

On the other hand, an organic EL display is called an active-matrix organic EL display, in which thin film transistors (TFTs) are provided at intersections of row electrodes (scanning lines) and column electrodes (data lines) and connected with gates of driving transistors which receive data signals, when the TFTs are turned on through selected scanning lines, through the data lines and activate the organic EL elements.

Unlike the passive-matrix organic EL display, in which organic EL elements connected to selected row electrodes (scanning lines) emit light only until the selected row electrodes become unselected, organic EL elements in the active-matrix organic EL display keep emitting light until they are scanned (or selected) again; thus causing no reduction in luminance even when a duty ratio increases. Accordingly, the active-matrix organic EL display is operated at a low voltage, thereby consuming less power. However, a problem of unevenness in luminance occurs in the active-matrix organic EL display because luminances are different among pixels due to a variation in characteristics of driving transistors or organic EL elements even when the same data signals are provided.

In conventional organic EL displays, such unevenness in luminance due to a variation or degradation in characteristics (hereinafter collectively referred to as unevenness in characteristics) of driving transistors or organic EL elements has typically been compensated by using complicated pixel circuitry or by feedback compensation using a representative pixel or the sum of currents flowing in all the pixels.

Using complicated pixel circuitry, however, reduces yields. Feedback compensation using a representative pixel or the sum of currents flowing in all the pixels cannot compensate unevenness in characteristics among pixels.

For these reasons, several methods have been proposed for detecting unevenness in characteristics among pixels using simple circuitry.

For example, for a substrate for a luminescent panel, a method for testing the substrate for the luminescent panel, and a luminescent panel disclosed in Patent Reference 1 (Japanese Unexamined Patent Application Publication Number 2006-139079), pixels are tested and characteristics of the pixels are extracted by detecting relationship between a data voltage and a current flowing in a driving transistor by measuring, before the EL element is formed on the substrate for a luminescent panel, a current flowing in a test line connected to a diode-connected transistor which is connected to a conventional voltage-driven pixel circuit including two transistors and serves to resemble an EL element. After the EL element is formed, the diode-connected transistor can be made reverse-biased using the test line, so that a current is prevented from flowing in the diode-connected transistor and thereby usual operation of writing a voltage can be performed. The characteristics detected as data items of a matrix can be utilized for controlling correction of voltage applied to a data line when an organic EL panel is used.

However, a drive current flowing in pixels is so fine that it is difficult to accurately measure such a fine current via a line, such as a test line, for measuring the current.

For the substrate for a luminescent panel, the method for testing the substrate for the luminescent panel, and the luminescent panel disclosed in the Patent Reference 1, accuracy in detection of characteristics of the driving transistor is poor because the characteristics are detected by measuring current. As a result, accuracy in detection of a variation in characteristics of driving transistors is so poor that unevenness among pixels is not corrected sufficiently.

The driving transistors of the pixels are connected to a common power supply and a common electrode in the luminescent panel. The test line described in the Patent Reference 1 is also connected to the common power supply and the common electrode in the light-emitting diode. Measurement of a fine current with good accuracy is difficult because the driving transistors are connected to the common electrode and the common power supply and thus the measurement is subject to influence of noise caused by a component other than a pixel which is currently being measured or influence of voltage drop or change in impedance due to load status of a component other than a pixel which is currently being measured.

Furthermore, as typified by the detection of the variation in characteristics of the driving transistors through the measurement of a fine current described in the Patent Reference 1, such a detection operation needs to be performed in an additionally provided period in which the luminescent panel actually does not perform a display operation. The period in which a display operation is performed may be limited because of the detection operation in the case, for example, where it is necessary that a variation in characteristics of the driving transistor is periodically detected to correct change with time.

The present invention, conceived to address the problem, has an object of providing a display device which allows, even with simple pixel circuitry, highly efficient and accurate detection of current of a driving active element of each pixel and a method for controlling the display device. The present invention also has an object of providing a method for detecting a variation in characteristics of the driving active element of each pixel with high accuracy using a result of the detection of the current.

SUMMARY OF THE INVENTION

In order to achieve the above-mentioned object, the display device according to an aspect of the present invention includes: a luminescence element; a first power line electrically connected to a first electrode of the luminescence element; a second power line electrically connected to a second electrode of the luminescence element; a capacitor which holds a voltage; a driving transistor which is provided between the first electrode and the first power line and causes the luminescence element to emit light, by passing a current between the first power line and the second power line, the current corresponding to the voltage held by the capacitor; a data line through which a signal voltage is supplied to one of electrodes of the capacitor; a first switching element which causes the capacitor to hold a voltage corresponding to the signal voltage; a data-line driver circuit which supplies the signal voltage to the data line; a voltage detection circuit which is connected to the data line and detects a voltage of the luminescence element; a second switching element which connects the data line and a connection point between the first electrode and the driving transistor; and a control unit configured to (i) cause the capacitor to hold the voltage corresponding to the signal voltage supplied through the data line by turning on the first switching element, (ii) cause the luminescence element to emit light by causing the driving transistor to pass, between the first power line and the second power line, the current corresponding to the voltage held by the capacitor, and (iii) cause the voltage detection circuit to detect an electric potential at the connection point via the data line by turning off the first switching element and turning on the second switching element while the luminescence element is emitting light.

Using a display device or a method for controlling the display device according to the present invention allows measurement of a test voltage for characteristics of driving transistors even with simple circuitry, and using the test voltage allows quick and easy detection of a drain current of the driving transistor of each pixel. Furthermore, detecting two separate drain currents allows calculation of a gain coefficient and a threshold voltage of the driving transistor, thus enabling correction of unevenness in luminances among pixels due to unevenness in characteristics of the driving transistor.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENTS

Figure 1:
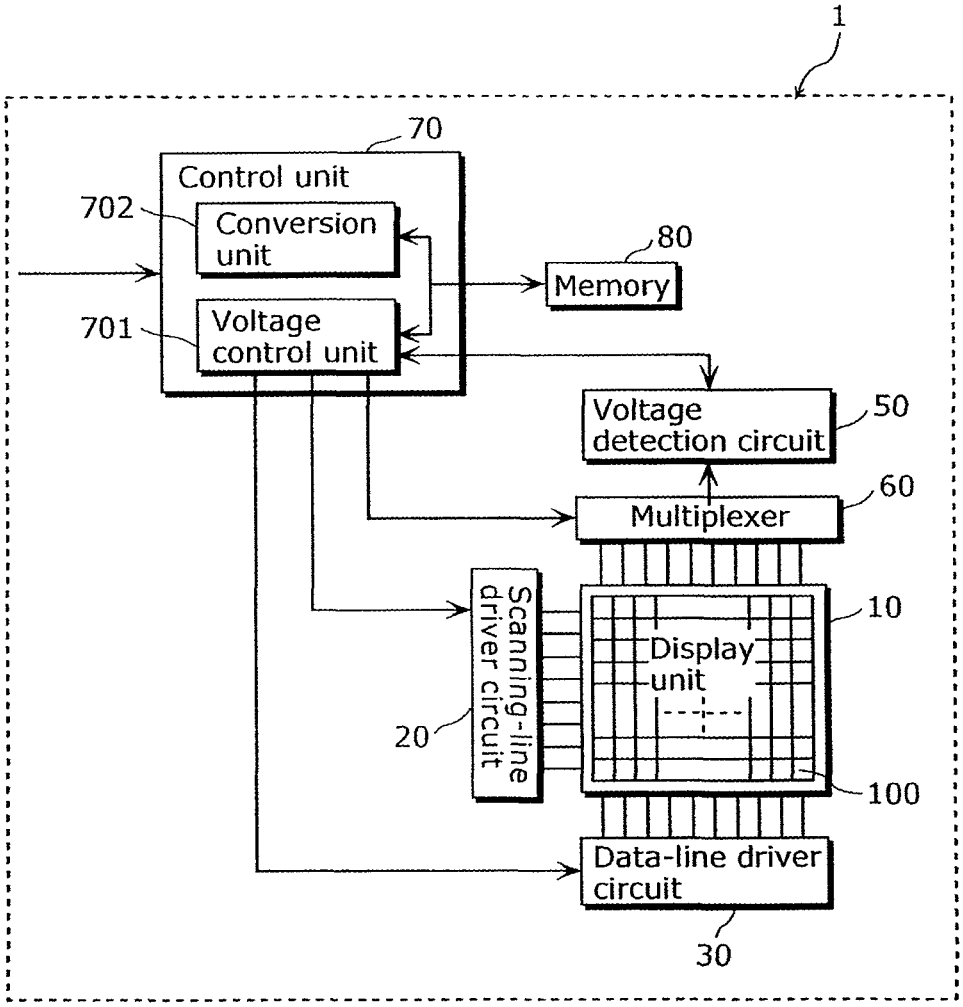
FIG. 1 is a block diagram which shows an electrical configuration of a display device according to a first embodiment of the present invention.

The display device according to an aspect of the present disclosure includes: a luminescence element; a first power line electrically connected to a first electrode of the luminescence element; a second power line electrically connected to a second electrode of the luminescence element; a capacitor which holds a voltage; a driving transistor which is provided between the first electrode and the first power line and causes the luminescence element to emit light, by passing a current between the first power line and the second power line, the current corresponding to the voltage held by the capacitor; a data line through which a signal voltage is supplied to one of electrodes of the capacitor; a first switching element which causes the capacitor to hold a voltage corresponding to the signal voltage; a data-line driver circuit which supplies the signal voltage to the data line; a voltage detection circuit which is connected to the data line and detects a voltage of the luminescence element; a second switching element which connects the data line and a connection point between the first electrode and the driving transistor; a control unit configured to (i) cause the capacitor to hold the voltage corresponding to the signal voltage supplied through the data line by turning on the first switching element, (ii) cause the luminescence element to emit light by causing the driving transistor to pass, between the first power line and the second power line, the current corresponding to the voltage held by the capacitor, and (iii) cause the voltage detection circuit to detect an electric potential at the connection point via the data line by turning off the first switching element and turning on the second switching element while the luminescence element is emitting light; and a conversion unit configured to convert the electric potential at the connection point detected by the voltage detection circuit into a drain current of the driving transistor.

According to the present aspect, the voltage detection circuit detects the electric potential at the connection point between the first electrode of the luminescence element and the driving transistor via the data line while the luminescence element is being caused to emit light by passing a current between the first power line and the second power line. With this, the electric potential at the connection point between the first electrode of the luminescence element and the driving transistor is detected with good accuracy using the signal voltage provided through the data line when the luminescence element is caused to emit light.

The current converted from the detected electric potential is equal to the drain current of the driving transistor because the luminescence element and the driving transistor are connected to each other. Thus, the drain current of the driving transistor is easily and accurately measured not using a special voltage input prepared for detecting the electric potential at the connection point between the first electrode of the luminescence element and the driving transistor but using the signal voltage provided through the data line when the luminescence element is caused to emit light.

Furthermore, according to the present aspect, a conversion unit is provided which converts the electric potential at the connection point, which is detected by the voltage detection circuit, between the first electrode of the luminescence element and the driving transistor into a drain current of the driving transistor. With this, the detected electric potential is converted into the current. The current converted from the detected electric potential is equal to the drain current of the driving transistor because the luminescence element and the driving transistor are connected to each other. Thus, the drain current of the driving transistor is easily and accurately measured not using a special voltage input prepared for detecting the electric potential at the connection point between the first electrode of the luminescence element and the driving transistor but using the signal voltage provided through the data line when the luminescence element is caused to emit light.

The display device according to another aspect of the present disclosure includes: a memory in which data corresponding to a voltage-current characteristic of the luminescence element is stored, wherein the conversion unit is configured to convert the electric potential at the connection point detected by the voltage detection circuit into the drain current of the driving transistor using the data corresponding to the voltage-current characteristic of the luminescence element and stored in the memory.

According to the present aspect, the display device is provided with a memory in which the data corresponding to the voltage-current characteristic of the luminescence element is stored. With this, the current flowing in the luminescence element is calculated from the data which is stored beforehand and corresponding to the voltage-current characteristic of the luminescence element and the electric potential at the connection point between the first electrode of the luminescence element detected by the voltage detection circuit and the driving transistor. The drain current of the driving transistor which is equal to the current is thereby obtained. Thus, the drain current of the driving transistor is quickly calculated from the electric potential detected by the voltage detection circuit.

The display device according to another aspect of the present disclosure is a display device, wherein the luminescence element, the capacitor, and the driving transistor are included in a pixel unit, and the data corresponding to the voltage-current characteristic of the luminescence element is data on the voltage-current characteristic of the luminescence element included in the pixel unit.

According to the present aspect, the data which corresponds to the voltage-current characteristic of the luminescence element may be data on the voltage-current characteristic of the luminescence element included in the pixel unit.

The display device according to a further aspect of the present disclosure includes pixel units each of which includes the luminescence element, the capacitor, and the driving transistor, wherein the data corresponding to the voltage-current characteristic of the luminescence element is data on the voltage-current characteristic of the luminescence element which is representative of luminescence elements included in the pixel units.

According to the present aspect, the data which corresponds to the voltage-current characteristic of the luminescence element may be data on the voltage-current characteristic of the luminescence element which is representative of luminescence elements included in the pixel units.

The display device according to an even further aspect of the present disclosure includes a luminescent panel which includes pixel units and data lines, each of the pixel units including the luminescence element, the capacitor, and the driving transistor, each of the data lines connected to a corresponding one of the pixel units, wherein the voltage detection circuit includes: at least one voltage detection unit configured to detect an electric potential at the connection point via at least one data line selected from among the data lines; and a multiplexer which is connected between the data lines and the at least one voltage detection unit and causes the at least one data line that is selected and the at least one voltage detection unit to electrically contact with each other, wherein the number of the at least one voltage detection unit is smaller than the number of the data lines.

According to the present aspect, the number of the at least one voltage detection circuit is smaller than the number of the data lines. With this, the number of the voltage detection circuits necessary for measurement of the electric potential at the connection point between the first electrode of the luminescence element and the driving transistor, thus the area for the display device or the number of parts is reduced.

The display device according to a still further aspect of the present disclosure is a display device, wherein the multiplexer is formed on the luminescent panel.

According to the present aspect, the multiplexer may be formed on the luminescent panel. In this case, the scale of the voltage detection circuit is reduced, thus the display device is manufactured less costly.

The display device according to another aspect of the present disclosure is a display device, wherein the first electrode is an anode of the luminescence element, and a voltage of the first power line is higher than a voltage of the second power line, to which a current flows from the first power line.

According to the present aspect, the first electrode of the luminescence element may be an anode of the luminescence element, and a voltage of the first power line may be higher than a voltage of the second power line, to which a current flows from the first power line.

A method for controlling a display device includes: a luminescence element; a first power line electrically connected to a first electrode of the luminescence element; a second power line electrically connected to a second electrode of the luminescence element; a capacitor which holds a voltage; a driving transistor which is provided between the first electrode and the first power line and causes the luminescence element to emit light, by passing a current between the first power line and the second power line, the current corresponding to the voltage held by the capacitor; a data line through which a signal voltage is supplied to one of electrodes of the capacitor; a first switching element which causes the capacitor to hold a voltage corresponding to the signal voltage; a data-line driver circuit which supplies the signal voltage to the data line; a voltage detection circuit which is connected to the data line and detects a voltage of the luminescence element; and a second switching element which connects the data line and a connection point between the first electrode and the driving transistor, and the method includes: (i) causing the capacitor to hold the voltage corresponding to the first signal voltage supplied through the data line by turning on the first switching element; (ii) causing the luminescence element to emit light by causing the driving transistor to pass, between the first power line and the second power line, the current corresponding to the voltage held by the capacitor; (iii) causing the voltage detection circuit to detect a first electric potential at the connection point via the data line by turning off the first switching element and turning on the second switching element while the luminescence element is emitting light; and (iv) converting the first electric potential at the connection point detected by the voltage detection circuit into a first current flowing between a source and a drain of the driving transistor.

According to the present aspect, the voltage detection circuit detects the electric potential at the connection point between the first electrode of the luminescence element and the driving transistor via the data line while the luminescence element is being caused to emit light by passing a current between the first power line and the second power line. With this, the electric potential at the connection point between the first electrode of the luminescence element and the driving transistor is detected with good accuracy using the signal voltage provided through the data line when the luminescence element is caused to emit light. The current converted from the detected electric potential is equal to the drain current of the driving transistor because the luminescence element and the driving transistor are connected to each other. Thus, the drain current of the driving transistor is easily and accurately measured not using a special voltage input prepared for detecting the electric potential at the connection point between the first electrode of the luminescence element and the driving transistor but using the signal voltage provided through the data line when the luminescence element is caused to emit light.

Furthermore, according to the present aspect, a conversion unit is provided which converts the electric potential at the connection point, which is detected by the voltage detection circuit, between the first electrode of the luminescence element and the driving transistor into a drain current of the driving transistor. With this, the detected electric potential is converted into the current. The current converted from the detected electric potential is equal to the drain current of the driving transistor because the luminescence element and the driving transistor are connected to each other. Thus, the drain current of the driving transistor is easily and accurately measured not using a special voltage input prepared for detecting the electric potential at the connection point between the first electrode of the luminescence element and the driving transistor but using the signal voltage provided through the data line when the luminescence element is caused to emit light.

The method for controlling a display device according to another aspect of the present disclosure is a method, wherein the display device includes a memory in which data corresponding to a voltage-current characteristic of the luminescence element is stored, and the method comprises converting the first electric potential at the connection point detected by the voltage detection circuit into the first current flowing between the source and the drain of the driving transistor using the data corresponding to the voltage-current characteristic of the luminescence element and stored in the memory.

According to the present aspect, a memory is provided in which the data corresponding to the voltage-current characteristic of the luminescence element is stored. With this, the current flowing in the luminescence element is calculated from the data which is stored beforehand and corresponding to the voltage-current characteristic of the luminescence element and the electric potential at the connection point between the first electrode of the luminescence element detected by the voltage detection circuit and the driving transistor. The drain current of the driving transistor which is equal to the current is thereby obtained. Thus, the drain current of the driving transistor is quickly calculated from the electric potential detected by the voltage detection circuit.

The method for controlling a display device according to a further aspect of the present disclosure further includes: (i) causing the capacitor to hold a voltage corresponding to a second signal voltage supplied through the data line by turning on the first switching element; (ii) causing the luminescence element to emit light by causing the driving transistor to pass, between the first power line and the second power line, a current corresponding to the voltage held by the capacitor; (iii) causing the voltage detection circuit to detect a second electric potential at the connection point via the data line and the second switching element by turning off the first switching element and turning on the second switching element while the luminescence element is emitting light; (iv) converting the detected second electric potential at the connection point into a second current flowing between the source and the drain of the driving transistor; and (v) calculating a gain coefficient and a threshold voltage of the driving transistor using the first electric potential, the second electric potential, the first current, and the second current.

According to the present aspect, use of two separate signal voltages while the luminescence element is emitting light as per normal allows detection of two separate drain currents of the driving transistor corresponding to the two separate signal voltages. In other words, the gain coefficient and the threshold voltage of the driving transistor are calculated using the first electric potential, the second electric potential, the first current, and the second current. This calculation of the gain coefficient and the threshold voltage of the driving transistor allows easy and quick calculation of a variation in gain coefficients and threshold voltages of driving transistors among pixels. Thus, unevenness in luminances due to unevenness in gain coefficients and threshold voltages of driving transistors among pixels is corrected with good accuracy.

The method for controlling a display device according to an even further aspect of the present disclosure is the method, wherein the display device includes a memory in which data corresponding to a voltage-current characteristic of the luminescence element is stored, and the method comprises converting the first electric potential and the second electric potential into the first current and the second current, respectively, using the data corresponding to the voltage-current characteristic of the luminescence element and stored in the memory.

According to the present aspect, the current flowing in the luminescence element is calculated from the data which is stored beforehand and corresponding to the voltage-current characteristic of the luminescence element and the electric potential at the connection point between the second electrode of the luminescence element detected by the voltage detection circuit and the driving transistor. The drain current of the driving transistor which is equal to the current is thereby obtained. Thus, the drain current of the driving transistor is quickly calculated from the electric potential detected by the voltage detection circuit.

The method for controlling a display device according to another aspect of the present disclosure includes calculating the gain coefficient and the threshold voltage of the driving transistor using a relational expression MATH. 1

$$\beta = \left( \frac{\sqrt{2I_1} - \sqrt{2I_2}}{V_{gs1} - V_{gs2}} \right)^2$$

$$Vth = \frac{V_{gs2} \times \sqrt{2I_1} - V_{gs1} \times \sqrt{2I_2}}{\sqrt{2I_1} - \sqrt{2I_2}},$$

wherein: Vgs1 is a voltage obtained by subtracting, from the first signal voltage, a power supply voltage set for the first power line connected to one of the source and the drain of the driving transistor; Vgs2 is a voltage obtained by subtracting the power supply voltage from the second signal voltage: I1 is the first current; I2 is the second current; β is a gain coefficient for a channel region, a capacity of an oxide film, and mobility of the driving transistor; and Vth is a threshold voltage of the driving transistor.

According to the present aspect, the gain coefficient and the threshold voltage of the driving transistor are calculated using the first electric potential at the connection point and the second electric potential at the connection point which are detected using the first signal voltage and the second signal voltage supplied while the luminescence element is emitting light, and thus a variation in gain coefficients and threshold voltages of driving transistors among pixels is easily and quickly calculated. Thus, unevenness in luminances due to unevenness in gain coefficients and threshold voltages of driving transistors among pixels is corrected with good accuracy.

The method for controlling a display device according to a further aspect of the present disclosure includes: a luminescence element; a first power line electrically connected to a first electrode of the luminescence element; a first power line electrically connected to a first electrode of the luminescence element; a first power line electrically connected to a first electrode of the luminescence element; a capacitor which holds a voltage; a driving transistor which is provided between the first electrode and the first power line and causes the luminescence element to emit light, by passing a current between the first power line and the second power line, the current corresponding to the voltage held by the capacitor; a data line through which a signal voltage is supplied to one of electrodes of the capacitor; a first switching element which causes the capacitor to hold a voltage corresponding to the signal voltage; a data-line driver circuit which supplies the signal voltage to the data line; a read line which reads a voltage of the luminescence element; a voltage detection circuit which is connected to the read line and detects a voltage of the luminescence element; a second switching element which connects the read line and a connection point between the first electrode and the driving transistor; a control unit configured to (i) cause the capacitor to hold the voltage corresponding to the signal voltage supplied through the data line by turning on the first switching element, (ii) cause the luminescence element to emit light by causing the driving transistor to pass, between the first power line and the second power line, the current corresponding to the voltage held by the capacitor, and (iii) cause the voltage detection circuit to detect an electric potential at the connection point via the read line by turning off the first switching element and turning on the second switching element while the luminescence element is emitting light; and a conversion unit configured to convert the electric potential at the connection point detected by the voltage detection circuit into a drain current of the driving transistor.

According to the present aspect, the voltage detection circuit detects the electric potential at the connection point between the first electrode of the luminescence element and the driving transistor via the data line while the luminescence element is being caused to emit light by passing a current between the first power line and the second power line. With this, the electric potential at the connection point between the first electrode of the luminescence element and the driving transistor is detected with good accuracy using the signal voltage provided through the data line when the luminescence element is caused to emit light.

The current converted from the detected electric potential is equal to the drain current of the driving transistor because the luminescence element and the driving transistor are connected to each other. Thus, the drain current of the driving transistor is easily and accurately measured not using a special voltage input prepared for detecting the electric potential at the connection point between the first electrode of the luminescence element and the driving transistor but using the signal voltage provided through the data line when the luminescence element is caused to emit light.

Furthermore, the voltage detection circuit detects the voltage of the luminescence element via the read line which is separate from the data line. Thus, the voltage of the luminescence element is measured more accurately without influence of voltage drop caused by a component of a basic circuit such as the first switching transistor because the voltage detection circuit detects the voltage of the luminescence element via the read line 53 which is not connected to the basic circuit.

Furthermore, according to the present aspect, a conversion unit is provided which converts the electric potential at the connection point, which is detected by the voltage detection circuit, between the first electrode of the luminescence element and the driving transistor into a drain current of the driving transistor. With this, the detected electric potential is converted into the current. The current converted from the detected electric potential is equal to the drain current of the driving transistor because the luminescence element and the driving transistor are connected to each other. Thus, the drain current of the driving transistor is easily and accurately measured not using a special voltage input prepared for detecting the electric potential at the connection point between the first electrode of the luminescence element and the driving transistor but using the signal voltage provided through the data line when the luminescence element is caused to emit light.

Preferred embodiments of the present invention are hereinafter described on the basis of the drawings. Elements which are common or equivalent among all the drawing are hereinafter denoted by the same symbol, and thus a description thereof is omitted.

First Embodiment

A first embodiment of the present invention is hereinafter described with reference to the drawings.

FIG. 1 is a block diagram which shows an electrical configuration of a display device according to a first embodiment of the present invention. The display device 1 includes a display unit 10, a scanning-line driver circuit 20, a data-line driver circuit 30, a voltage detection circuit 50, a multiplexer 60, a control unit 70, and a memory 80.

Figure 2:
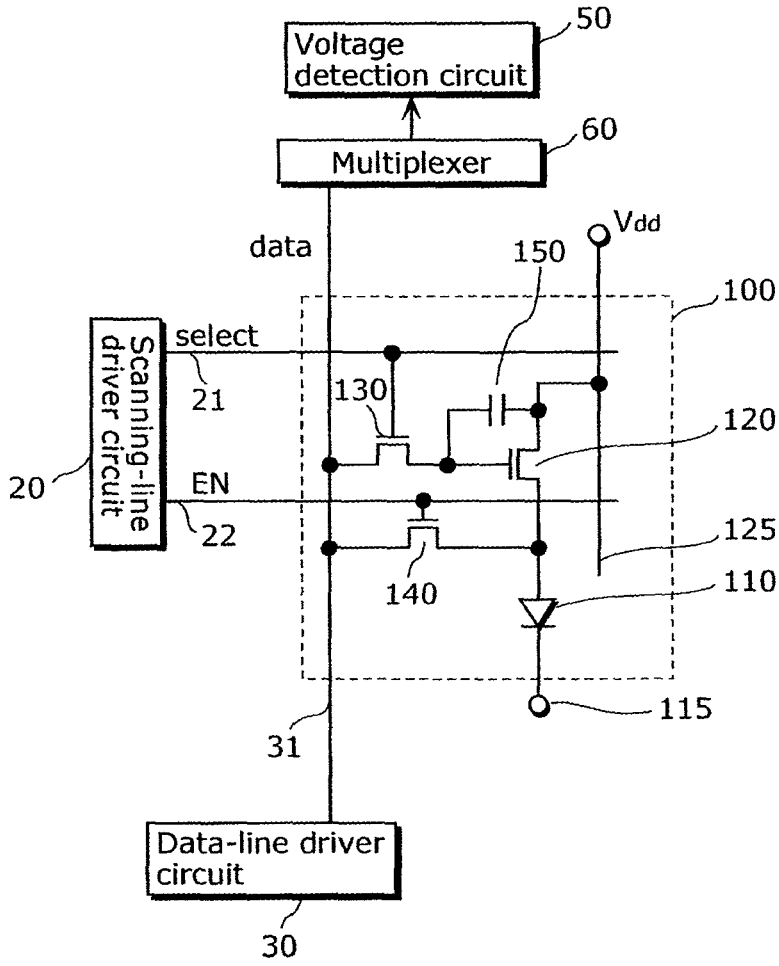
FIG. 2 is a diagram which shows a circuitry configuration of a pixel unit of the display device according to the first embodiment of the present invention, and connection of the pixel unit with peripheral circuitry thereof.

FIG. 2 is a diagram which shows a circuitry configuration of a pixel unit of the display device according to the first embodiment of the present invention, and connection of the pixel unit with peripheral circuitry thereof. A pixel unit 100 in FIG. 2 includes an organic EL element 110, a driving transistor 120, a switching transistor 130, a test transistor 140, a capacitance element 150, a common electrode 115, a power line 125, a scanning line 21, a control line 22, and a data line 31. The peripheral circuitry includes the scanning-line driver circuit 20, the data-line driver circuit 30, the voltage detection circuit 50, and the multiplexer 60.

First described are functions of the elements shown in FIG. 1.

The display unit 10 is a display panel which includes a plurality of the pixel units 100.

The scanning-line driver circuit 20 is connected to the scanning line 21 and the control line 22 and has a function of controlling conduction and non-conduction of the switching transistor 130 and the test transistor 140 of each of the pixel units 100 via the scanning line 21 and the control line 22, respectively.

The data-line driver circuit 30 has a function of providing the data line 31 with signal voltage. The data-line driver circuit 30 opens and shorts the connection with the data line 31 by changing internal impedance or using an internal switch.

The data line 31 is connected to a pixel column which includes the pixel units 100, and the signal voltage provided by the data-line driver circuit 30 is provided for each of the pixel units of the pixel column through the data line 31.

The voltage detection circuit 50, which functions as a voltage detection unit together with the multiplexer 60 through which the voltage detection circuit 50 is connected to the data line 31, has a function of detecting an anode voltage of the organic EL element 110 when the test transistor 140 is conductive. The detected anode voltage is equal to a drain voltage at a time when a gate voltage charged in the capacitance element 150 is applied to the driving transistor 120 and a drain current of the driving transistor 120 thereby flows.

The multiplexer 60 has a function of switching conduction and non-conduction between the voltage detection circuit 50 and the data line 31 connected to the voltage detection circuit 50.

The voltage detection circuit 50 may be incorporated in a data driver IC with the data-line driver circuit 30 or provided externally to the data driver IC.

Figure 3:
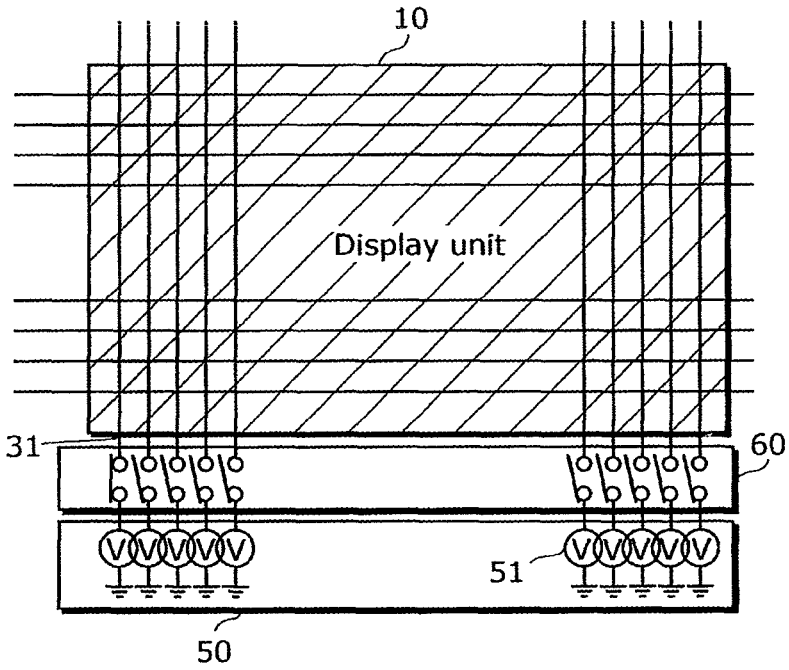
FIG. 3 is a diagram which shows a first configuration of the voltage detection unit of the display device according to the first embodiment of the present invention.

FIG. 3 is a diagram which shows a first configuration of the voltage detection unit of the display device according to the first embodiment of the present invention. The voltage detection circuit 50 may have a plurality of the voltage detection units 51 as many as a plurality of the data lines 31 as shown in FIG. 3. In this case, each of the voltage detection units 51 is connected to corresponding one of the data lines 31 via the multiplexer 60.

Figure 4:
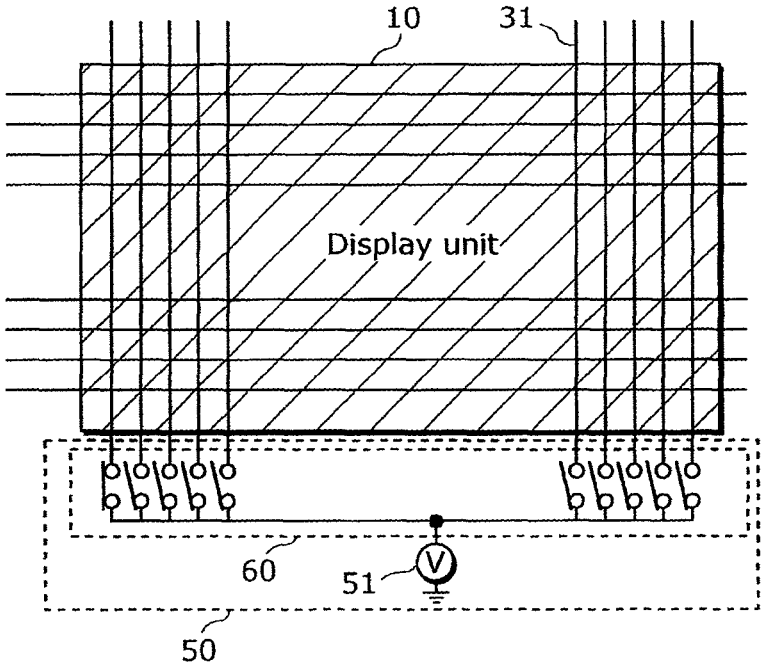
FIG. 4 is a diagram which shows a second configuration of the voltage detection unit of the display device according to the first embodiment of the present invention.

FIG. 4 is a diagram which shows a second configuration of the voltage detection unit of the display device according to the first embodiment of the present invention. The voltage detection circuit 50 preferably has the multiplexer 60, which switches between the data lines 31, and the voltage detection units 51 fewer than the data lines 31 as shown in FIG. 4. This configuration reduces the number of the voltage detection units 51 necessary for measurement of the anode voltage of the organic EL element 110, thus the area for the display device or the number of parts is reduced. In this case, the multiplexer 60 may be provided externally to the voltage detection circuit 50.

Figure 5:
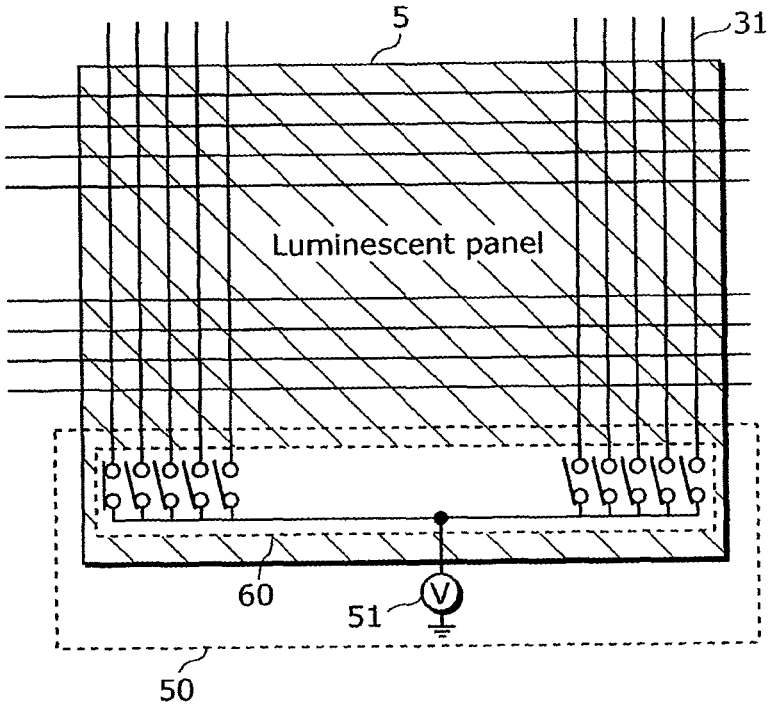
FIG. 5 is a diagram which shows a third configuration of the voltage detection unit of the display device according to the first embodiment of the present invention.

FIG. 5 is a diagram which shows a third configuration of the voltage detection unit of the display device according to the first embodiment of the present invention. As shown in FIG. 5, the multiplexer 60 may be formed on a luminescent panel 5 in the case where the voltage detection circuit 50 has the multiplexer 60, which switches between the data lines 31, and the voltage detection units 51 fewer than the data lines 31. This configuration reduces the scale of the voltage detection circuit, thus the display device is manufactured less costly. Again, the multiplexer 60 may be provided externally to the voltage detection circuit 50.

Hereinafter, the functions of the elements shown in FIG. 1 are further described.

The control unit 70 includes a voltage control unit 701 and a conversion unit 702.

The voltage control unit 701 has a function of causing the voltage detection circuit 50 to detect an anode voltage of the organic EL element 110 by controlling the scanning-line driver circuit 20, the data-line driver circuit 30, the voltage detection circuit 50, the multiplexer 60, and the memory 80.

The conversion unit 702 converts the anode voltage of the organic EL element 110 detected by the voltage detection circuit 50 into a value of current flowing in the organic EL element 110 using data on a voltage-current characteristic of the organic EL element stored in the memory 80. Furthermore, the conversion unit 702 obtains a gain coefficient and a threshold voltage of the driving transistor 120 by performing an operation, which is described later, using the value of the current flowing in the organic EL element 110 obtained by the conversion. The conversion unit 702 writes, in the memory 80, the obtained gain coefficient and the threshold voltage of each of the pixel units.

Subsequently, for a display operation of each of the pixel units after the gain coefficient and the threshold voltage are written in the memory 80, the control unit 70 reads out the gain coefficient and threshold voltage and corrects image signal data provided externally on the basis of the gain coefficient and the threshold voltage, and then outputs the corrected image signal data to the data-line driver circuit 30.

The memory 80 is connected to the control unit 70 and stores the data on the voltage-current characteristic of the organic EL element. The current flowing in the organic EL element 110 is calculated from the stored data on the voltage-current characteristic and the detected anode voltage of the organic EL element 110, and then a drain current of the driving transistor, which is equal to the current flowing in the organic EL element 110, is quickly obtained.

The data on the voltage-current characteristic stored beforehand in the memory 80 may be data on a voltage-current characteristic of the organic EL element which is representative of the luminescent panel or data on a voltage-current characteristic of the organic EL element 110 of each of the pixel units. With this configuration, the drain current of the driving transistor 120 is calculated with good accuracy.

The data on the voltage-current characteristic stored beforehand in the memory 80 may be updated periodically or in response to change in characteristics of the organic EL element 110 with time.

Next, a configuration of internal circuitry of the pixel unit 100 is described with reference to FIG. 2.

The organic EL element 110, which functions as a luminescent element, emits light depending on the drain current provided from the driving transistor 120. The organic EL element 110 has a cathode, which is a second electrode thereof, is connected to the common electrode 115 and usually grounded.

The driving transistor 120 has a gate which is connected to the data line 31 via the switching transistor 130, and a source and a drain one of which is connected to the power line 125 and the other of which is connected to the anode which is a first electrode of the organic EL element 110. The power line 125 is connected to a power supply of a constant voltage Vdd.

This circuit connection allows the signal voltage provided by the data-line driver circuit 30 to be applied to the gate of the driving transistor 120 via the data line 31 and the switching transistor 130. Then drain current corresponding to the signal voltage applied to the gate of the driving transistor 120 flows into the organic EL element 110 from the anode of the organic EL element 110.

The switching transistor 130, which functions as a first switching element, has a gate which is connected to the scanning line 21, and a source and a drain one of which is connected to the data line 31 and the other one of which is connected to the gate of the driving transistor 120 and one of electrodes of the capacitance element 150. Here, the switching transistor 130 is turned on when the voltage level of the scanning line 21 becomes high, and then the signal voltage is applied to the gate of the driving transistor 120, and at the same time the capacitance element 150 is caused to hold a voltage corresponding to the signal voltage.

The test transistor 140, which functions as a second switching element, has a gate which is connected to the control line 22, and a source and a drain one of which is connected to the anode which is one of the terminals of the organic EL element 110 and the other one of which is connected to the data line 31. Here, the test transistor 140 is turned on when the voltage level of the control line 22 becomes high, and the anode voltage of the organic EL element 110 is detected by the voltage detection circuit 50 via the data line 31.

The capacitance element 150, which is a capacitor to hold a voltage, has terminals one of which is connected to the gate of the driving transistor 120 and the other one of which is connected to one of the source and the drain of the driving transistor 120. The capacitance element 150 holds the signal voltage provided for the gate of the driving transistor 120, and thus an anode voltage of the organic EL element 110 is detected using the data line 31, the test transistor 140, and the voltage detection circuit 50 while a drain current corresponding to the signal voltage is flowing.

With the circuitry configuration, the anode voltage of the organic EL element, that is, the voltage of the connection point between the driving transistor 120 and the organic EL element 110, is measured with good accuracy using the signal voltage provided through the data-line driver circuit while the organic EL element 110 is emitting light. The measured anode voltage of the organic EL element may be converted into a current flowing into the organic EL element using a conversion method described later. The current obtained by the conversion is equal to the drain current of the driving transistor because the organic EL element and the driving transistor are connected to each other. Thus, the drain current of the driving transistor is easily and accurately measured using the anode voltage of the organic EL element which is measured not using a special input voltage additionally prepared for measuring the anode voltage but using a signal voltage of the organic EL element emits light in a usual operation of light emission.

Hereinafter, a method for controlling the display device according to the first embodiment of the present invention is described.

Figure 6:
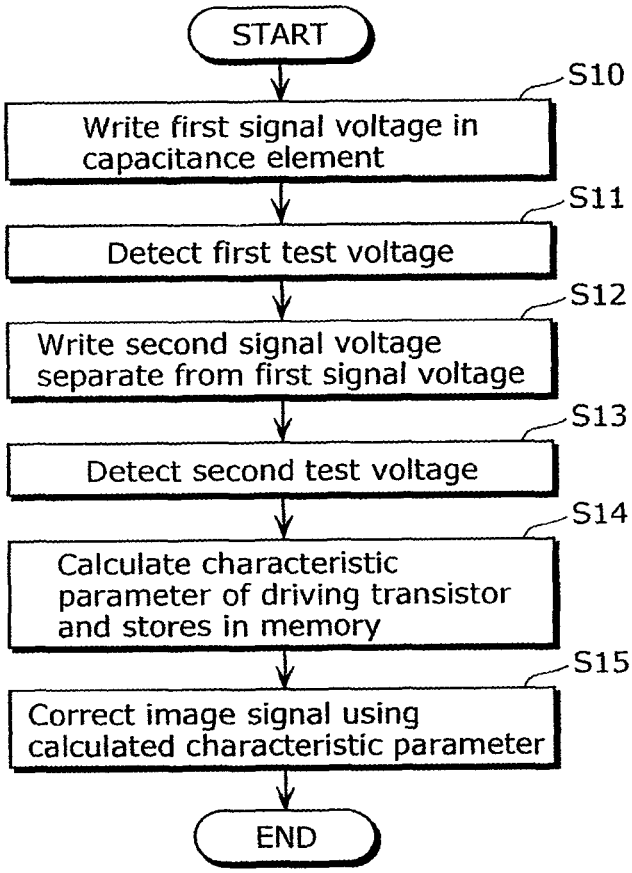
FIG. 6 is an operation flowchart which shows the method for controlling the display device according to the first embodiment of the present invention.

FIG. 6 is an operation flowchart which shows the method for controlling the display device according to the first embodiment of the present invention.

First, the voltage control unit 701 writes, in the capacitance element 150, a first signal voltage provided by the data-line driver circuit 30 and causes the driving transistor 120 to output a first current which corresponds to the first signal voltage (S10).

Next, the voltage control unit 701 causes the voltage detection circuit 50 to detect an anode voltage of the organic EL element 110 for which the first signal voltage is being provided (S11).

Next, the voltage control unit 701 writes, in the capacitance element 150, a second signal voltage which is provided by the data-line driver circuit 30 and separate from the first signal voltage, and causes the driving transistor 120 to output a second current corresponding to the second signal voltage (S12).

Next, the voltage control unit 701 causes the voltage detection circuit 50 to detect an anode voltage of the organic EL element 110 for which the second signal voltage is being provided (S13).

Next, the conversion unit 702 calculates a gain coefficient and a threshold voltage of the driving transistor 120 from the first signal voltage and the second signal voltage written in the capacitance element 150 in Step S10 and Step S12, respectively, a first test voltage and a second test voltage obtained in Step S11 and Step S13, respectively, and the data on the voltage-current characteristic of the organic EL element stored beforehand in the memory 80. Then, the conversion unit 702 stores the calculated gain coefficient and the calculated threshold voltage in the memory 80 (S14). A method for calculating the gain coefficient and the threshold voltage of the driving transistor 120 is described later.

Finally, the control unit 70 reads the calculated gain coefficient and the calculated threshold voltage from the memory 80 and corrects provided image signal as data voltage (S15).

Here is an exemplary operation performed by the control unit 70 in Step S15.

Figure 7:
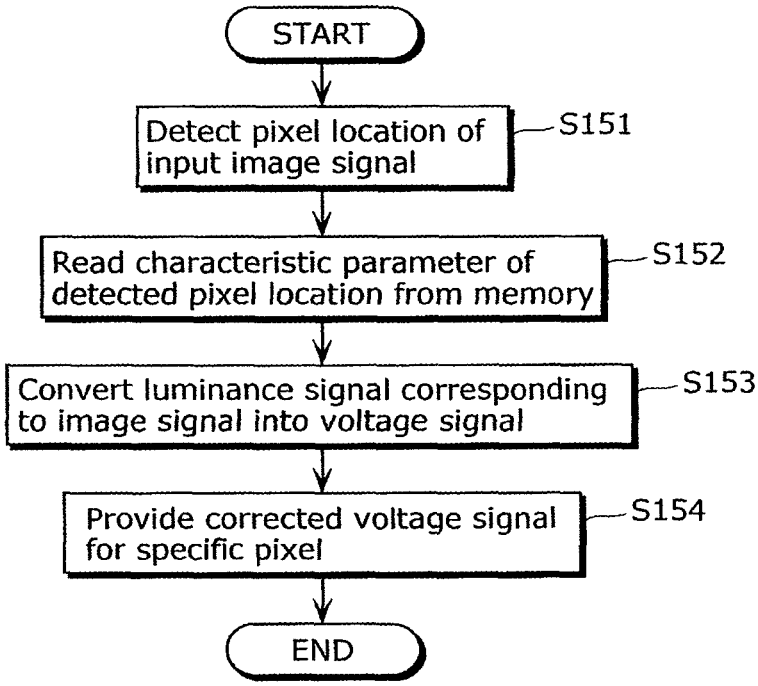
FIG. 7 is an operation flowchart which shows the method for correction by the control unit according to the first embodiment of the present invention.

FIG. 7 is an operation flowchart which shows the method for the correction by the control unit according to the first embodiment of the present invention.

First, the control unit 70 detects pixel location of an externally provided image signal using a synchronization signal provided in parallel with the image signal (S151).

Next, the control unit 70 reads the gain coefficient and the threshold voltage of each pixel with reference to the memory 80 (S152).

Next, the control unit 70 converts a luminance signal corresponding to the image signal into a data voltage corrected using the gain coefficient and the threshold (S153).

Finally, the control unit 70 provides the corrected data voltage for the data-line driver circuit 30 so that the corrected data voltage is provided for a specific pixel (S154).

Hereinafter, timing of provision and detection of an electric signal for operations performed in Step S10 and Step S11 in the operation flowchart shown in FIG. 6 is described with reference to FIG. 8 and FIGS. 9A to 9C.

Figure 8:
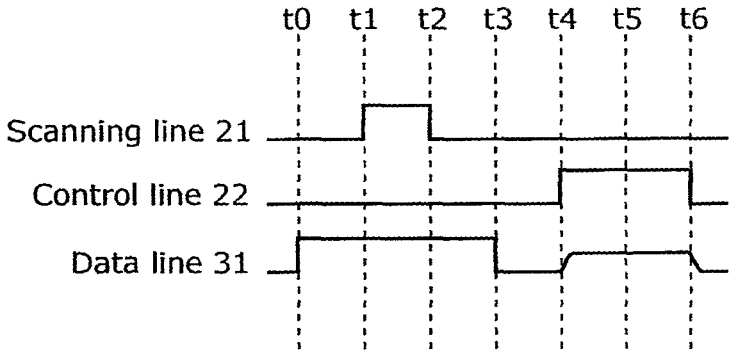
FIG. 8 is a timing chart which shows timing of provision of a signal voltage and timing of detection of a test voltage for detecting characteristics of the driving transistor according to the first embodiment of the present invention.

FIG. 8 is a timing chart which shows timing of provision of the signal voltage and timing of detection of the test voltage for detecting characteristics of the driving transistor according to the first embodiment of the present invention. In FIG. 8, the horizontal axis indicates time. Vertically aligned are, from top to bottom, waveforms of voltage generated in the scanning line 21, voltage generated in the control line 22, and voltage of the data line 31.

First, at a time t0, the data-line driver circuit 30 provides the first signal voltage for the data line 31.

Next, at a time t1, a level of the voltage of the scanning line 21 becomes high, and the switching transistor 130 is thereby turned on. This causes the first signal voltage to be applied to the gate of the driving transistor 120 and to be written in the capacitance element 150.

Figure 9A:
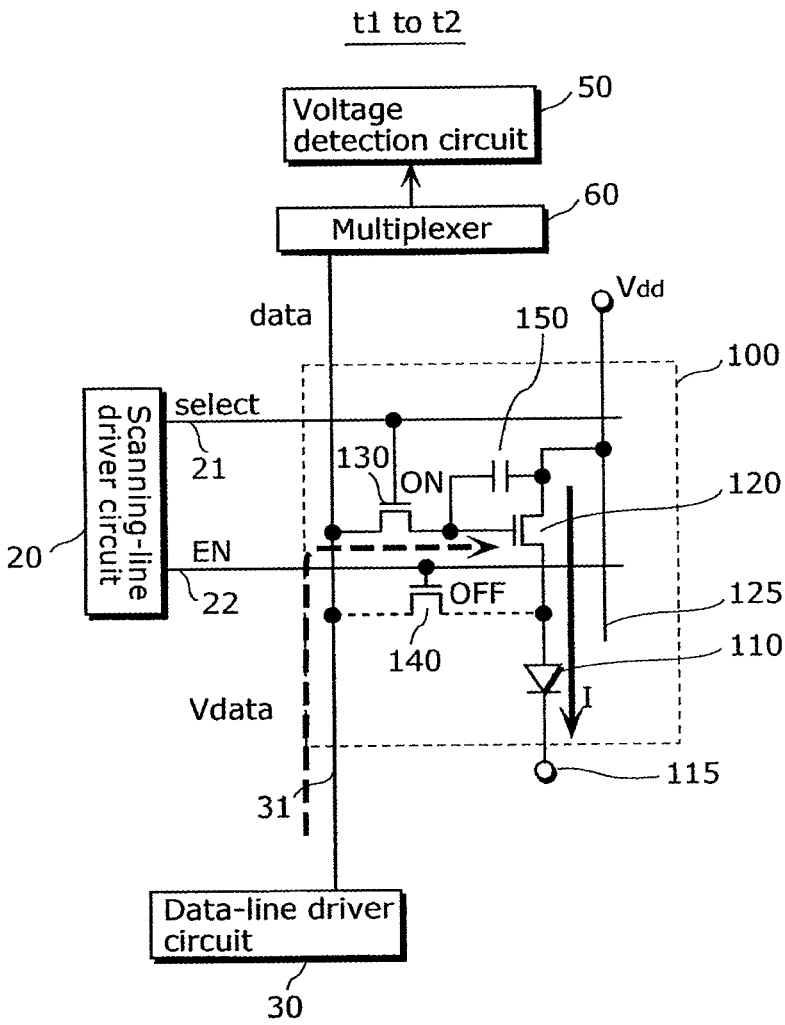
FIG. 9A is a circuit diagram which shows operations of the display device according to the first embodiment of the present invention from a time t1 to a time t2.

FIG. 9A is a circuit diagram which shows operations of the display device according to the first embodiment of the present invention from the time t1 to a time t2.

The first signal voltage and the second signal voltage are data voltages to be used for actual displaying operations. At the time t1, the driving transistor 120 passes, to the organic EL element 110, the current corresponding to the first signal voltage. This causes the organic EL element 110 to start emitting light.

Next, at the time t2, the level of the voltage of the scanning line 21 becomes low, and the switching transistor 130 is thereby turned off. This stops the application of the first signal voltage to the gate of the driving transistor 120 and finishes the writing of the first signal voltage in the capacitance element 150. At this time, the driving transistor 120 continues to pass, to the organic EL element 110, the current corresponding to the first voltage held by the capacitance element 150. The organic EL element 110 thereby continues emitting light.

Figure 9B:
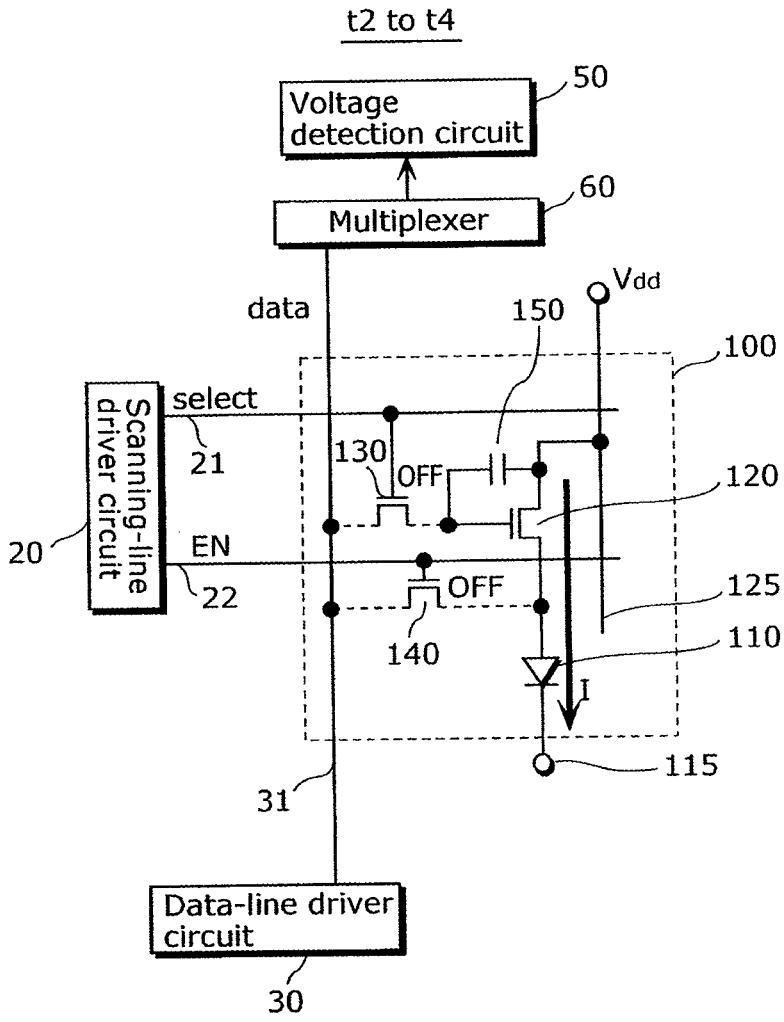
FIG. 9B is a circuit diagram which shows operations of the display device according to the first embodiment of the present invention from a time t2 to a time t4.

FIG. 9B is a circuit diagram which shows operations of the display device according to the first embodiment of the present invention from the time t2 to a time t4.

Next, at a time t3, the data-line driver circuit 30 stops the providing of the first signal voltage to the data line 31, and the data-line driver circuit 30 is thereby put in high-impedance state. This makes the connection between the data-line driver circuit 30 and the data line 31 open.

Next, at a time t4, a level of the voltage of the control line 22 becomes high, and the test transistor 140 is thereby turned on. This causes the anode of the organic EL element 110 and the data line 31 to electrically contact with each other.

Figure 9C:
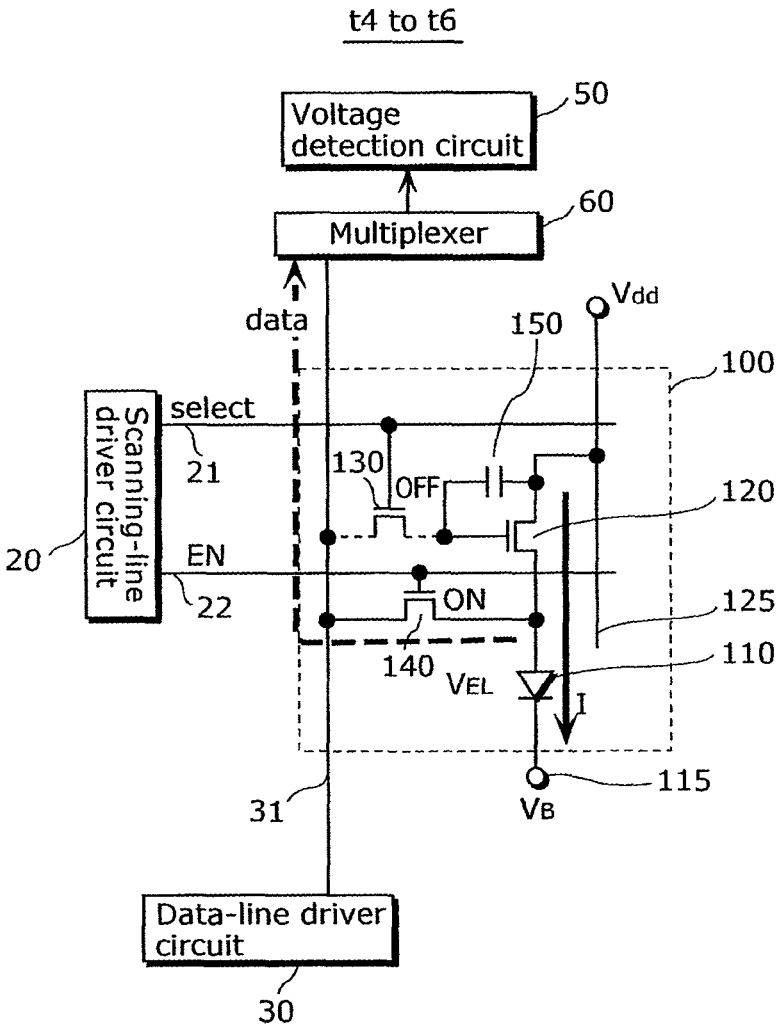
FIG. 9C is a circuit diagram which shows operations of the display device according to the first embodiment of the present invention from a time t4 to a time t6.

FIG. 9C is a circuit diagram which shows operations of the display device according to the first embodiment of the present invention from the time t4 to a time t6.

Next, at a time t5, the voltage detection circuit 50 detects the voltage of the data line 31 while the organic EL element 110 is emitting light, and the anode voltage of the organic EL element 110 is thereby detected.

Finally, at a time t6, the level of the voltage of the control line 22 becomes low, and the test transistor 140 is thereby turned off. This is the end of the operations in sequence.

This timing chart is also applicable to timing of provision and detection of the electric signal in the operations in Step S12 and Step S13 shown in FIG. 6 when the first signal voltage in this timing chart is read as the second signal voltage.

By following Steps shown in FIG. 6 according to the timing chart shown in FIG. 8, the two measured separate anode voltages of the organic EL element 110 are measured accurately using the two separate signal voltages provided by the data-line driver circuit 30 while the organic EL element 110 is emitting light. Furthermore, the two measured separate anode voltages of the organic EL element 110 are converted into two separate currents flowing in the organic EL element 110 using the voltage-current characteristic of the organic EL element stored beforehand in the memory 80. The two separate currents are equal to drain currents of the driving transistor 120 because the organic EL element 110 and the driving transistor 120 are connected to each other. Thus, two separate drain currents of the driving transistor 120 are easily and accurately measured using the two anode voltages of the organic EL element 110 which are measured not using a special input voltage additionally provided in order to measure the voltages but using two separate signal voltages while the organic EL element 110 is emitting light as per normal.

Hereinafter, a method for calculating the gain coefficient and the threshold voltage of the driving transistor 120 in Step 14 performed in the operation flowchart shown in FIG. 6 is described. Specifically, here described are two methods: a method for converting the detected anode voltage of the organic EL element 110 into the drain current of the driving transistor 120; and a method for calculating the gain coefficient and the threshold voltage of the driving transistor 120 using the two separate signal voltages described above and two separate drain currents of the driving transistor 120 which correspond to the two separate signal voltages.

First, for $I_{test}$ which is a drain current of the driving transistor 120: where a signal voltage written in the capacitance element 150 is $V_{det}$, and a power supply voltage applied to the source terminal of the driving transistor 120 is $V_{dd}$, then, $$I_{test}=(\beta/2)(V_{det}-V_{dd}-Vth)^2 \quad \text{(Eq. 1)}$$

Here, β denotes a gain coefficient for a channel region, a capacity of an oxide film, and a mobility of the driving transistor 120. Vth denotes a threshold voltage of the driving transistor 120 and relates to the mobility.

Here, the drain current of the driving transistor 120 is calculated from an anode voltage of the organic EL element 110 and the voltage-current characteristic of the organic EL element 110.

Figure 10:
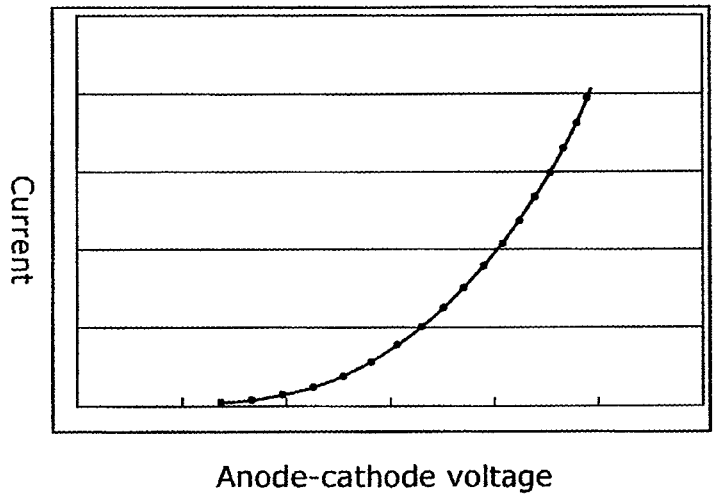
FIG. 10 is a graph which shows an example of a voltage-current characteristic of an organic EL element.

FIG. 10 is a graph which shows an example of a voltage-current characteristic of an organic EL element. In FIG. 10, the horizontal axis indicates voltages applied to between the anode and the cathode of the organic EL element, and the vertical axis indicates currents flowing in the organic EL element. This voltage-current characteristic of the organic EL element is stored beforehand in, for example, the memory 80. Data on the voltage-current characteristic stored in the memory 80 is preferably data on a voltage-current characteristic of the organic EL element which is representative of the luminescent panel.

The current flowing in the organic EL element 110 is obtained by converting the anode voltage of the organic EL element 110 detected at the time t5 shown in FIG. 8 using the voltage-current characteristic of the organic EL element, which is shown in FIG. 10, read from the memory 80. The current obtained by the conversion is equal to the drain current flowing in the driving transistor 120. The drain current $I_{test}$ of the driving transistor 120 is thus converted from the anode voltage of the organic EL element 110.

Next, for $I_1$ and $I_2$ which are drain currents of the driving transistor 120 when $V_{det1}$ and $V_{det2}$ which are two signal voltages of different magnitudes are provided for the driving transistor 120, respectively: where $$I_1=(\beta/2)(V_{det1}-V_{dd}-Vth)^2 \quad \text{(EQ. 2) and}$$

$$I_2=(\beta/2)(V_{det2}-V_{dd}-Vth)^2 \quad \text{(EQ. 3).}$$

Here, for β and Vth: where Vgs1=Vdet1−Vdd and Vgs2=Vdet2−Vdd, then,

[Math. 2]

$$\beta=\left(\frac{\sqrt{2I_1}-\sqrt{2I_2}}{V_{gs1}-V_{gs2}}\right)^2 \quad \text{(EQ. 4)}$$

$$Vth=\frac{V_{gs2}\times\sqrt{2I_1}-V_{gs1}\times\sqrt{2I_2}}{\sqrt{2I_1}-\sqrt{2I_2}}$$

The gain coefficient and the threshold voltage of the driving transistor 120 are thus calculated using the first current $I_1$ and the second current $I_2$ which are obtained by converting anode voltages of the organic EL element 110 measured when the first signal voltage $Vgs_1$ and the second voltage $Vgs_2$ are provided for the capacitance element 150.

The first signal voltage $Vgs_1$ and the second voltage $Vgs_2$ are detected in the data line 31 by, for example, the voltage detection circuit 50.

These characteristic parameters such as the gain coefficient and the threshold voltage described above may have values different among pixels due to a manufacturing variation of driving transistors. When the gain coefficient and the threshold voltage of each of the pixels obtained by the method for calculation described above are stored in the memory 80, unevenness in luminance among pixel units caused by such a variation in characteristics of driving transistors is reduced using the gain coefficient and the threshold voltage which is read from the memory 80 while the organic EL element subsequently is emitting light.

The data on the voltage-current characteristic of the organic EL element stored in the memory 80 may be data on a voltage-current characteristic of a organic EL element 110 of each of the pixel units or items of data on a voltage-current characteristic of organic EL elements per block which includes a plurality of pixel units as a unit. With this configuration, the drain current of the driving transistor 120 is calculated more accurately. Thus, in accordance with the first embodiment of the present invention, the test voltage for characteristics of the driving transistor is measured accurately, even with simple pixel circuitry, while the organic EL element is emitting light. In addition, by using the test voltage and the voltage-current characteristic of the luminescence element stored beforehand, a drain current of the driving transistor of each pixel is calculated easily, quickly, and accurately. Furthermore, by using the calculated drain current, characteristic parameters of the driving transistor of each pixel unit is calculated. By using these characteristic parameters, unevenness in luminance among pixels due to such a variation in characteristics of driving transistors is corrected.

Second Embodiment

A second embodiment of the present invention is hereinafter described with reference to the drawings.

Figure 11:
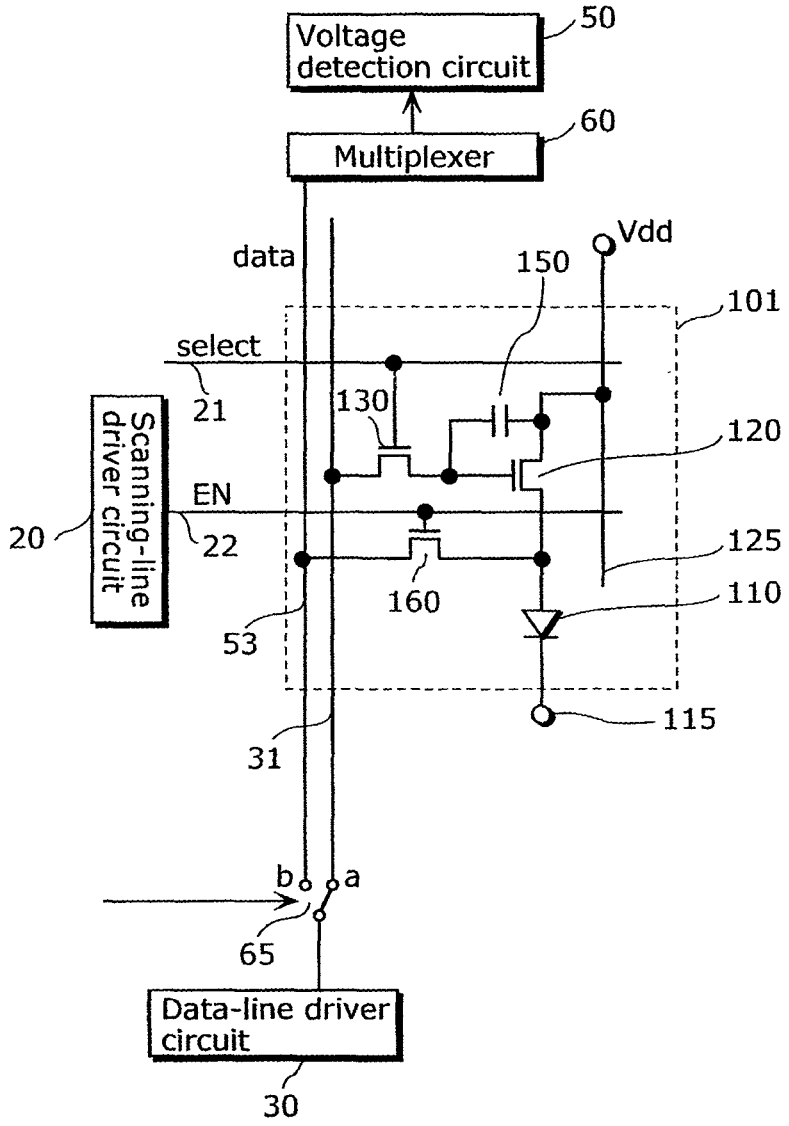
FIG. 11 is a diagram which shows a circuitry configuration of a pixel unit of the display device according to a second embodiment of the present invention, and connection of a pixel unit with peripheral circuitry thereof.

FIG. 11 is a diagram which shows a circuitry configuration of a pixel unit of the display device according to the second embodiment of the present invention, and connection of the pixel unit with peripheral circuitry thereof. A pixel unit 101 in FIG. 11 includes an organic EL element 110, a driving transistor 120, a switching transistor 130, a test transistor 160, a capacitance element 150, a common electrode 115, a power line 125, a scanning line 21, a control line 22, a data line 31, and a read line 53. The peripheral circuitry includes a scanning-line driver circuit 20, a data-line driver circuit 30, a voltage detection circuit 50, a multiplexer 60, and a voltage selection switch 65. Compared to the display device according to the first embodiment, a display device according to the second embodiment of the present invention is different in a configuration in which a read line 53 is provided for each pixel column and the voltage selection switch 65 is provided which is used for selecting a connection of the read line 53 with the data-line driver circuit 30 or a connection of the data line 31 with data-line driver circuit 30. Compared to the pixel unit 100, the pixel unit 101 is different in a configuration in which the test transistor 160 is connected not to the data line 31 but to the read line 53. The following description refers only to differences from the first embodiment, and a description of points in common with the first embodiment is omitted.

The scanning-line driver circuit 20 is connected to the scanning line 21 and the control line 22 and has a function of controlling conduction and non-conduction of the switching transistor 130 and the test transistor 160 of each of the pixel unit 101, via the scanning line 21 and the control line 22, respectively.

The data-line driver circuit 30 has a function of providing the data line 31 with signal voltage. The data-line driver circuit 30 opens and shorts the connection with the data line 31 using the voltage selection switch 65.

The voltage detection circuit 50, which functions as a voltage detection unit together with the multiplexer 60 through which the voltage detection circuit 50 is connected to the read line 53, has a function of detecting anode voltage of the organic EL element 110 when the test transistor 160 is conductive. The detected anode voltage is equalized to a drain voltage generated by a drain current of the driving transistor 120 by a gate voltage of the driving transistor 120 charged by the capacitance element 150.

The multiplexer 60 has a function of switching conduction and non-conduction between the voltage detection circuit 50 and the read line 53 connected to the voltage detection circuit 50.

The test transistor 160, which functions as a second switching element, has a gate which is connected to the control line 22, and a source and a drain one of which is connected to the anode which is one of the terminals of the organic EL element 110 and the other one of which is connected to the read line 53. Here, the test transistor 160 is turned on when the voltage level of the control line 22 becomes high, and the anode voltage of the organic EL element 110 is detected by the voltage detection circuit 50 via the read line 53.

The capacitance element 150, which is a capacitor to hold a voltage, has terminals one of which is connected to the gate of the driving transistor 120 and the other one of which is connected to one of the source and the drain of the driving transistor 120. The capacitance element 150 holds the signal voltage provided for the gate of the driving transistor 120, and thus an anode voltage of the organic EL element 110 is detected using the read line 53, the test transistor 160, and the voltage detection circuit 50 while a drain current corresponding to the signal voltage is flowing.

With the circuitry configuration, the anode voltage of the organic EL element, that is, the voltage of the connection point between the driving transistor 120 and the organic EL element 110, is measured with good accuracy using the signal voltage provided through the data-line driver circuit while the organic EL element 110 is emitting light. The measured anode voltage of the organic EL element may be converted into a current flowing into the organic EL element using a conversion method described later. The current obtained by the conversion is equal to the drain current of the driving transistor because the connection of the organic EL element and the driving transistor are connected to each other. Thus, the drain current of the driving transistor is easily and accurately measured using the anode voltage of the organic EL element which is measured not using a special input voltage additionally prepared for measuring the anode voltage but using a signal voltage of the organic EL element emits light in a usual operation of light emission.

In addition, the current-voltage characteristic of the organic EL element is measured more accurately without influence of voltage drop caused by the switching transistor 130 in detection of a voltage because a path for application of current and a path for detection of the voltage are provided separately.

Hereinafter, a method for controlling the display device according to the second embodiment of the present invention is described.

An operation flowchart which shows a method for controlling the display device according to the second embodiment of the present invention and an operation flowchart which shows a method for correcting by the control unit according to the second embodiment of the present invention are respectively the same as FIG. 6 and FIG. 7 described for the first embodiment; thus descriptions thereof are omitted.

Hereinafter, timing of provision and detection of an electric signal for operations performed in Step S10 and Step S11 in the operation flowchart shown in FIG. 6 is described with reference to FIG. 12.

Figure 12:
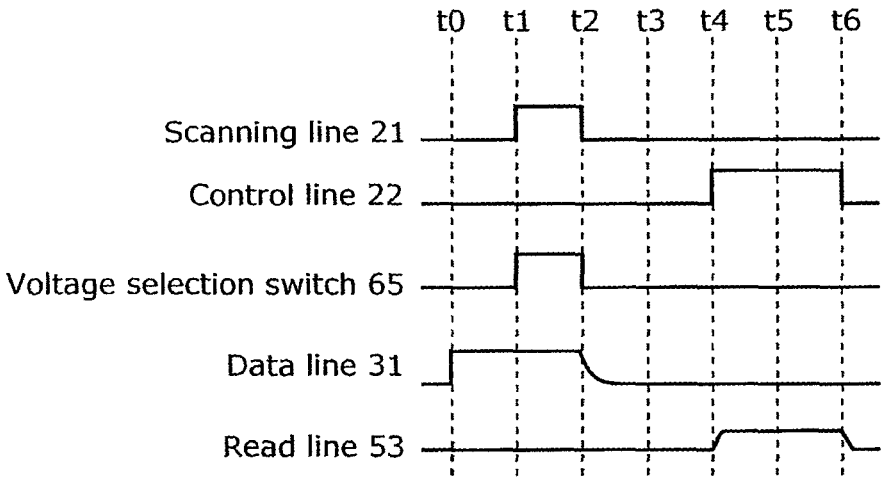
FIG. 12 is a timing chart which shows timing of provision of a signal voltage and timing of detection of a test voltage for detecting a characteristic of a driving transistor according to the second embodiment of the present invention.

FIG. 12 is a timing chart which shows timing of provision of the signal voltage and timing of detection of the test voltage for detecting a characteristic of the driving transistor according to the second embodiment of the present invention. In FIG. 12, the horizontal axis indicates time. Vertically aligned are, from top to bottom, waveforms of voltage generated in the scanning line 21, voltage generated in the control line 22, voltage generated in the voltage selection switch 65, voltage of the data line 31, and voltage of the read line 53.

First, at a time t0, the data-line driver circuit 30 provides a first signal voltage for the data line 31.

Next, at a time t1, a level of the voltage of the voltage selection switch 65 is turned to high, thereby causing the data-line driver circuit 30 and the data line 31 to electrically contact with each other, a level of the voltage of the scanning line 21 to become high, and the switching transistor 130 to be turned on. This causes a first signal voltage to be applied to the gate of the driving transistor 120 and to be written in the capacitance element 150.

The first signal voltage and the second signal voltage are data voltages to be used for actual displaying operations. At the time t1, the driving transistor 120 passes, to the organic EL element 110, the current corresponding to the first signal voltage. This causes the organic EL element 110 to start emitting light.

Next, at a time t2, a level of the voltage of the voltage selection switch 65 is turned to low, thereby causing the data-line driver circuit 30 and the read line 53 to electrically contact with each other, a level of the voltage of the scanning line 21 to become low, and the switching transistor 130 to be turned off. This stops the application of the first signal voltage to the gate of the driving transistor 120 and finishes the writing of the first signal voltage in the capacitance element 150. At this time, the driving transistor 120 continues to pass, to the organic EL element 110, the current corresponding to the first voltage held by the capacitance element 150. The organic EL element 110 thereby continues emitting light.

Next, at a time t4, a level of the voltage of the control line 22 becomes high, and the test transistor 160 is thereby turned on. This causes the anode of the organic EL element 110 and the read line 53 to electrically contact with each other.

Next, at a time t5, the voltage detection circuit 50 detects the voltage of the read line 53 while the organic EL element 110 is emitting light, and the anode voltage of the organic EL element 110 is thereby detected.

Finally, at a time t6, the level of the voltage of the control line 22 becomes low, and the test transistor 160 is thereby turned off. This is the end of the operations in sequence.

This timing chart is also applicable to timing of provision and detection of the electric signal in the operations in Step S12 and Step S13 shown in FIG. 6 when the first signal voltage in this timing chart is read as the second signal voltage.

By following Steps shown in FIG. 6 according to the timing chart shown in FIG. 12, the two measured separate anode voltages of the organic EL element 110 are measured accurately using the two separate signal voltages provided by the data-line driver circuit 30 while the organic EL element 110 is emitting light. Furthermore, the two measured separate anode voltages of the organic EL element 110 are converted into two separate currents flowing in the organic EL element 110 using the voltage-current characteristic of the organic EL element stored beforehand in the memory 80. The two separate currents are equal to drain currents of the driving transistor because the organic EL element 110 and the driving transistor 120 are connected to each other. Thus, two separate drain currents of the driving transistor 120 are easily and accurately measured using the two anode voltages of the organic EL element 110 which are measured not using a special input voltage additionally provided in order to measure the voltage but using two separate signal voltages while the organic EL element 110 is emitting light as per normal.

In addition, the anode voltage of the organic EL element 110 is measured more accurately without influence of voltage drop caused by a component of a basic pixel circuit such as the switching transistor 130 because the voltage detection circuit 50 detects the anode voltage of the organic EL element 110 via the read line 53 which is not connected to the basic pixel circuit.

Although a display device and a method for controlling the same according to the present invention have been described above using the first and the second embodiments but not limited to these embodiments. The present invention also includes variations of the embodiments above or apparatuses including a display device according to the present invention which would occur to those skilled in the art and be within the spirit and scope of the present invention.

Figure 13:
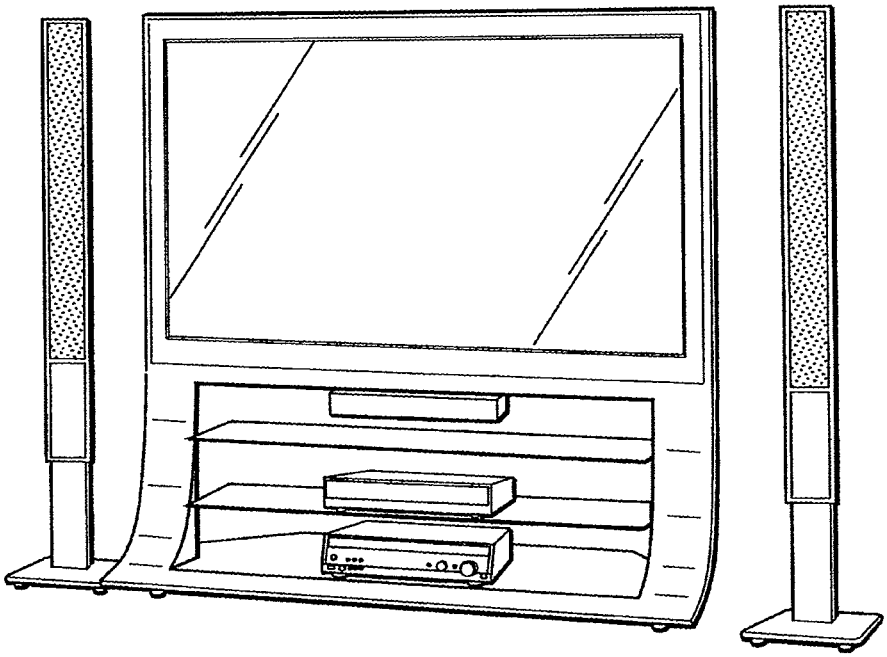
FIG. 13 is an outline view of a thin flat-screen TV which includes a display device according to the present invention.

For example, a display device and a method for controlling the same according to the present invention is included or used in a thin flat-screen TV as shown in FIG. 13. The display device and the method for controlling the same according to the present invention provide a thin TV which includes a display for which unevenness in luminance is reduced.

The luminescence element of the pixel unit may have a cathode which is connected to one of a source and a drain of a driving transistor and an anode which is connected to a first power supply, the driving transistor may have a gate, as in the embodiments described above, which is connected to a data line via a switching transistor, and the other one of the source and the drain of the driving transistor may be connected to a second power supply. For this circuitry configuration, electric potential of the first power supply is set to higher than that of the second power supply. A test transistor has a gate which is connected to a control line and a source and a drain one of which is connected to the data line and the other one of which to the cathode of the luminescence element. This circuitry configuration provides a display device with the same configuration and the same advantageous effect as those of the present invention.

Furthermore, the switching transistor, the test transistor, and the driving transistor, which are described as n-type transistors to be turned on when the voltage level of the gate of the switching transistor is high, may be p-type transistors to be used with an electronic apparatus for which polarity of the data line, scanning line, and the control line are inverted. Such an electronic apparatus allows easily and accurately obtaining drain currents of the driving transistor and a gain coefficient and a threshold voltage calculated using the source-drain voltages; thus providing the same advantageous effects as in the embodiments above.

Although the embodiment according to the present invention assumes that the transistor, which functions as a driving transistor, a switching transistor, or a test transistor, is described as a field effect transistor (FET) which has a gate, a source, and a drain, the transistor may be a bipolar transistor which has a base, a collector, and an emitter. This also achieves the object of the present invention and provides the same advantageous effects.

INDUSTRIAL APPLICABILITY

The present invention is applicable to organic EL flat panel displays having a display device, and is well suited for use as a display device including a display for which evenness in image quality is required or as a method for detecting a variation in properties of such a display device.

What is claimed is:

1. A display device, comprising:

a luminescence element including a first electrode and a second electrode;

a first power line electrically connected to the first electrode;

a second power line electrically connected to the second electrode;

a capacitor including a third electrode and a fourth electrode, the capacitor holding a voltage;

a driving transistor between the first electrode and the first power line that passes a current between the first power line and the second power line, the current corresponding to the voltage held by the capacitor;

a data line through which a signal voltage is supplied to one of the third electrode and the fourth electrode;

a data-line driver that supplies the signal voltage to the data line;

a first switch between the data line and the one of the third electrode and the fourth electrode for switchedly supplying the capacitor with the signal voltage;

a voltage detector connected to the data line for detecting an electric potential at a connection point between the luminescence element and the driving transistor;

a second switch between the data line and the first electrode;

a controller that causes the capacitor to hold the voltage corresponding to the signal voltage supplied through the data line by switching on the first switch, the driving transistor to pass, between the first power line and the second power line, a current corresponding to the voltage held by the capacitor, and the voltage detector to detect the electric potential at the connection point via the data line by switching off the first switch, switching on the second switch, and putting the data-line driver in a high impedance state; and a determiner that determines a drain current of the driving transistor based on the electric potential detected by the voltage detector, wherein the controller causes the voltage detector to detect the electric potential at the connection point via the data line using the voltage corresponding to the signal voltage supplied through the data line and not using a special voltage input from the data-line driver.

2. The display device according to claim 1, wherein the controller drives the display device using an active-matrix scheme.

3. The display device according to claim 1, further comprising:

a memory that stores data corresponding to a voltage-current characteristic of the luminescence element, wherein the determiner determines the drain current of the driving transistor based on the electric potential detected by the voltage detector using the data corresponding to the voltage-current characteristic of the luminescence element.

4. The display device according to claim 3, wherein the luminescence element, the capacitor, and the driving transistor are included in a pixel, and the data corresponding to the voltage-current characteristic of the luminescence element is data on the voltage-current characteristic of the luminescence element included in the pixel.

5. The display device according to claim 3, further comprising:

a plurality of pixels, each of which includes the luminescence element, the capacitor, and the driving transistor, wherein the data corresponding to the voltage-current characteristic of the luminescence element is data on the voltage-current characteristic of the luminescence element which is representative of each luminescence element included in the plurality of pixels.

6. The display device according to claim 3, further comprising:

a luminescent panel that includes a plurality of pixels and a plurality of the data line, each of the plurality of pixels including the luminescence element, the capacitor, and the driving transistor, each of the plurality of the data line connected to one of the plurality of pixels, wherein the voltage detector includes:

at least one voltage detector that detects the electric potential at the connection point of one of the plurality of pixels via a corresponding one of the plurality of the data line; and a multiplexer that is connected to each of the plurality of the data line and the at least one voltage detector and causes the corresponding one of the plurality of the data line and the at least one voltage detector to electrically contact with each other, and wherein a number of the at least one voltage detector is less than a number of the plurality of the data line.

7. The display device according to claim 6, wherein the multiplexer is formed on the luminescent panel.

8. The display device according to claim 1, wherein the first electrode is an anode of the luminescence element, and a voltage of the first power line is higher than a voltage of the second power line, to which a current flows from the first power line.

9. The display device according to claim 1, wherein the controller further causes the capacitor to hold a second voltage corresponding to a second signal voltage which is different in value from the signal voltage and is supplied through the data line by switching on the first switch, the driving transistor to pass, between the first power line and the second power line, a second current corresponding to the second voltage held by the capacitor, and the voltage detector to detect a second electric potential at the connection point via the data line by switching off the first switch, switching on the second switch, and putting the data-line driver in a high impedance state, and the determiner determines the drain current and a second drain current based on the electric potential and the second electric potential detected by the voltage detector, respectively, and calculates a gain coefficient and a threshold voltage of the driving transistor based on the electric potential, the second electric potential, the first drain current, and the second drain current.

10. A method for controlling a display device, the display device comprising:

a luminescence element including a first electrode and a second electrode;

a first power line electrically connected to the first electrode;

a second power line electrically connected to the second electrode;

a capacitor including a third electrode and a fourth electrode, the capacitor holding a voltage;

a driving transistor between the first electrode and the first power line that passes a current between the first power line and the second power line, the current corresponding to the voltage held by the capacitor;

a data line through which a signal voltage is supplied to one of the third electrode and the fourth electrode;

a data-line driver that supplies the signal voltage to the data line;

a first switch between the data line and the one of the third electrode and the fourth electrode for switchedly supplying the capacitor with the signal voltage;

a voltage detector connected to the data line for detecting an electric potential at a connection point between the luminescence element and the driving transistor; and a second switch between the data line and the first electrode, the method comprising:

causing the capacitor to hold a first voltage corresponding to a first signal voltage supplied through the data line by switching on the first switch;

causing the driving transistor to pass, between the first power line and the second power line, a first current corresponding to the first voltage held by the capacitor;

causing the voltage detector to detect a first electric potential at the connection point via the data line by switching off the first switch, switching on the second switch, and putting the data-line driver in a high impedance state; and determining a first drain current of the driving transistor based on the first electric potential detected by the voltage detector, wherein the voltage detector is caused to detect the first electric potential at the connection point via the data line using the voltage corresponding to the signal voltage supplied through the data line and not using a special voltage input from the data-line driver.

11. The method according to claim 10, wherein the controller drives the display device using an active-matrix scheme.

12. The method according to claim 10, wherein the display device further comprises a memory that stores data corresponding to a voltage-current characteristic of the luminescence element, and the method further comprises:

determining the first drain current of the driving transistor based on the first electric potential detected by the voltage detector using the data corresponding to the voltage-current characteristic of the luminescence element.

13. The method according to claim 10, the method further comprising:

causing the capacitor to hold a second voltage corresponding to a second signal voltage supplied through the data line by switching on the first switch;

causing the driving transistor to pass, between the first power line and the second power line, a second current corresponding to the second voltage held by the capacitor;

causing the voltage detector to detect a second electric potential at the connection point via the data line by switching off the first switch, switching on the second switch, and putting the data-line driver in a high impedance state;

determining a second drain current of the driving transistor based on the second electric potential detected by the voltage detector; and calculating a gain coefficient and a threshold voltage of the driving transistor based on the first electric potential, the second electric potential, the first drain current, and the second drain current.

14. The method according to claim 13, wherein the display device further comprises a memory that stores data corresponding to a voltage-current characteristic of the luminescence element, and the method further comprises:

determining the first drain current and the second drain current based on the first electric potential and the second electric potential, respectively, using the data corresponding to the voltage-current characteristic of the luminescence element.

15. The method claim 13, comprising calculating the gain coefficient and the threshold voltage of the driving transistor using a relational expression $$\beta = \left( \frac{\sqrt{2I_1} - \sqrt{2I_2}}{V_{gs1} - V_{gs2}} \right)^2$$

$$Vth = \frac{V_{gs2} \times \sqrt{2I_1} - V_{gs1} \times \sqrt{2I_2}}{\sqrt{2I_1} - \sqrt{2I_2}},$$

wherein:

Vgs1 is a voltage obtained by subtracting, from the first signal voltage, a power supply voltage set for the first power line connected to one of the source and the drain of the driving transistor;

Vgs2 is a voltage obtained by subtracting the power supply voltage from the second signal voltage:

I1 is the first drain current;

I2 is the second drain current;

β is a gain coefficient for a channel region, a capacity of an oxide film, and mobility of the driving transistor; and Vth is the threshold voltage of the driving transistor.

16. A display device, comprising:

a luminescence element including a first electrode and a second electrode;

a first power line electrically connected to the first electrode;

a second power line electrically connected to the second electrode;

a capacitor including a third electrode and a fourth electrode, the capacitor holding a voltage;

a driving transistor between the first electrode and the first power line that passes a current between the first power line and the second power line, the current corresponding to the voltage held by the capacitor;

a data line through which a signal voltage is supplied to one of the third electrode and the fourth electrode;

a data-line driver that supplies the signal voltage to the data line;

a first switch between the data line and the one of the third electrode and the fourth electrode for switchedly supplying the capacitor with the signal voltage;

a read line is separate from the data line and that reads an electric potential at a connection point between the luminescence element and the driving transistor;

a voltage detector connected to the read line for detecting the electric potential at the connection point;

a second switch between the read line and the first electrode;

a controller that causes the capacitor to hold the voltage corresponding to the signal voltage supplied through the data line by switching on the first switch, the driving transistor to pass, between the first power line and the second power line, a current corresponding to the voltage held by the capacitor, and the voltage detector to detect the electric potential at the connection point via the read line by switching off the first switch, switching on the second switch, and putting the data-line driver in a high impedance state; and a determiner that determines a drain current of the driving transistor based on the electric potential detected by the voltage detector, wherein the controller causes the voltage detector to detect the electric potential at the connection point via the read line using the voltage corresponding to the signal voltage supplied through the data line and not using a special voltage input from the data-line driver.

17. The display device according to claim 1, wherein the controller drives the display device using an active-matrix scheme.

* * * * *